US005510060A

United States Patent [19]

Knoll

[11] Patent Number: 5,510,060

[45] Date of Patent: Apr. 23, 1996

[54] INLINE CARBONATOR

[76] Inventor: George W. Knoll, 11375 Olson Rd., Belvidere, Ill. 61008

[21] Appl. No.: 404,104

[22] Filed: Mar. 14, 1995

[51] Int. Cl.[6] ..... B01F 3/04

[52] U.S. Cl. ..... 261/27; 261/76; 261/122.1; 261/DIG. 7

[58] Field of Search ..... 261/27, DIG. 7, 261/122.1, 76

[56] References Cited

U.S. PATENT DOCUMENTS

| | | | |
|---|---|---|---|
| 1,945,489 | 1/1934 | Manley | 261/DIG. 7 |
| 2,072,350 | 3/1937 | Welker et al. | 261/DIG. 7 |
| 2,201,430 | 5/1940 | Deibel | 261/DIG. 7 |
| 2,229,441 | 1/1941 | Carlson | 261/DIG. 7 |
| 3,256,802 | 6/1966 | Karr | 261/122.1 |
| 3,397,871 | 8/1968 | Hasselberg | 261/DIG. 7 |
| 3,851,797 | 12/1974 | Jacobs | 261/DIG. 7 |
| 4,093,681 | 6/1978 | Castillo et al. | 261/122.1 |
| 5,037,584 | 8/1991 | Toll | 261/76 |
| 5,062,548 | 11/1991 | Hedderick et al. | 261/DIG. 7 |

*Primary Examiner*—Tim R. Miles
*Attorney, Agent, or Firm*—Vernon J. Pillote

[57] ABSTRACT

A carbonator comprising a casing defining an elongate chamber having a helically grooved inner wall and an elongate inner body disposed in the chamber and having a cylindrical outer surface contacting radially inner crests on the helically grooved inner wall to form a helical flow passage therewith. Liquid to be carbonated is supplied to the helical flow passage adjacent one end thereof and an outlet communicates with said helical flow passage adjacent a second end. The inner body has an inner gas chamber extending only along a portion of the length of the helical flow passage, which portion is formed of micro-porous material for diffusing carbon dioxide gas from the inner chamber into the liquid in the helical flow passage.

10 Claims, 1 Drawing Sheet

FIG. 1
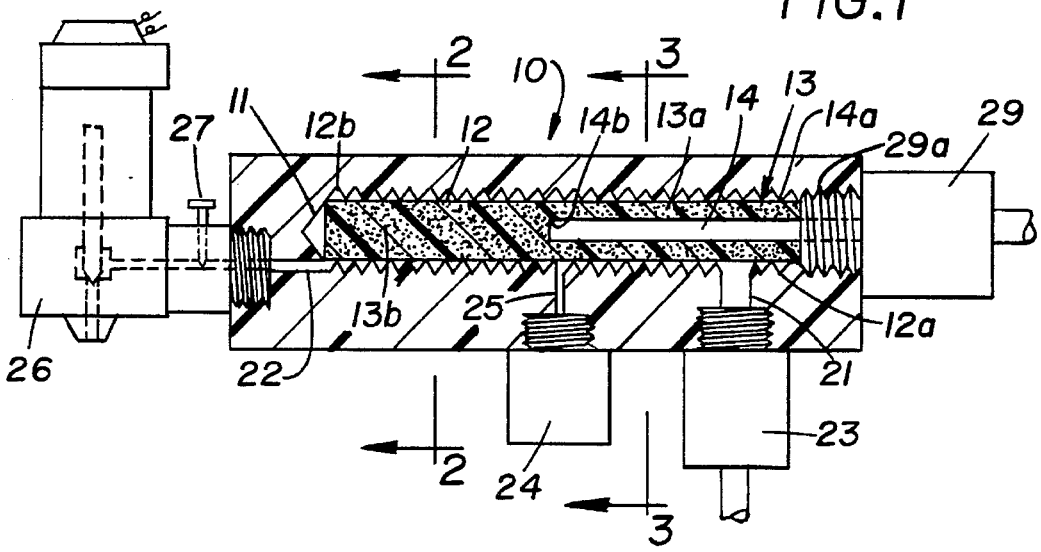
FIG. 2
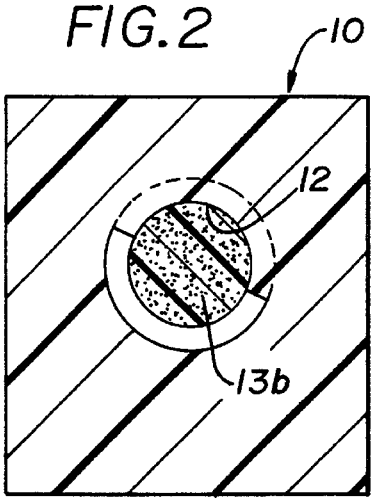
FIG. 3
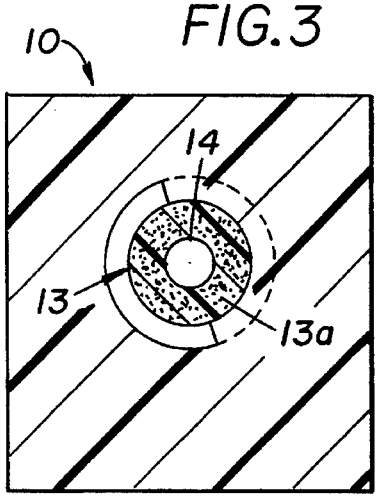
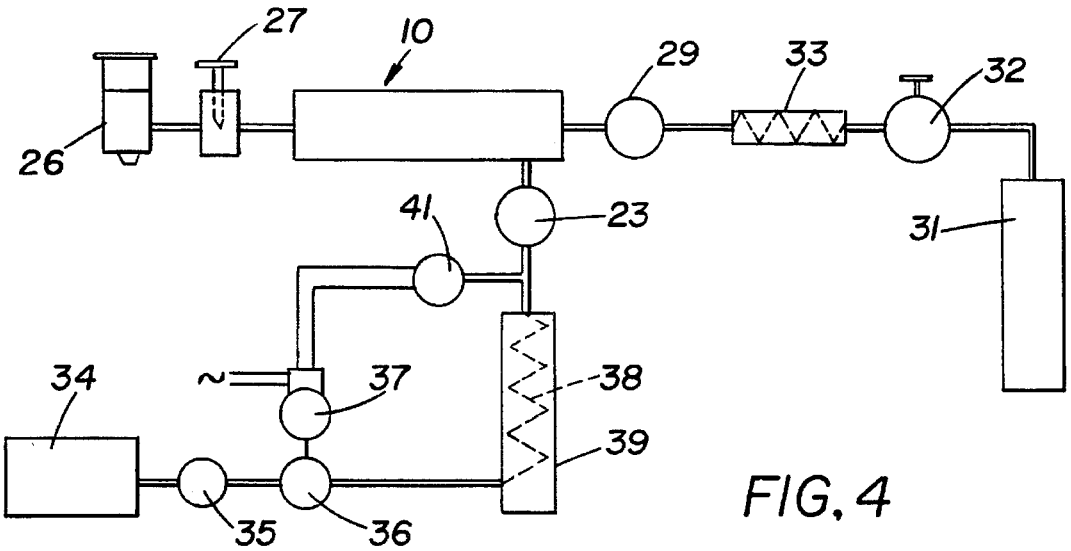
FIG. 4

INLINE CARBONATOR

BACKGROUND OF THE INVENTION

It is recognized that if carbon dioxide is brought into contact with liquid and mixed extensively over a long period of time or in a relatively large scale apparatus, it is possible to produce a satisfactory carbonated liquid. However, proper carbonation of the liquid becomes more difficult where a relatively small scale apparatus is used and where the carbonator is to occupy a relatively small space, for example in a drink dispensing machine in which the liquid is carbonated before use.

It is known, for example as disclosed in U.S. Pat. Nos. 1,945,489; 2,072,350; 2,201,430; and 3,851,797, to provide a diffuser type carbonator in which carbon dioxide gas is introduced inside a tubular or sleeve shaped micro-porous body which diffuses the carbon dioxide gas into a stream of liquid flowing over the outer side of the micro-porous body.

SUMMARY OF THE INVENTION

It is the general object of the invention to provide an inline carbonator apparatus of the type having a micro-porous diffuser, and which has an improved construction that enhances mixing and dissolution of the carbon dioxide gas in a small scale apparatus and reduces loss of carbonation in the carbonated liquid during dispensing.

Accordingly, the present invention provides an inline carbonator apparatus comprising a casing defining an elongate chamber having a helically grooved inner wall and an elongate inner body disposed in the chamber and having a cylindrical outer surface contacting radially inner crests of the helically grooved inner wall and forming a helical flow passage therewith. Liquid to be carbonated is supplied to the helical flow passage adjacent an inlet end and outlet means communicates with the helical flow passage adjacent an outlet end. The inner body has an elongate internal chamber extending from adjacent the inlet end of the helical flow passage to a location spaced from the inlet and outlet ends of the helical flow passage. At least that portion of the inner body that extends around the inner chamber is formed of a micro-porous material for diffusing carbon dioxide gas as it passes from the internal chamber into the liquid in the helical flow passage.

During dispensing, liquid enters adjacent the inlet end of the helical flow passage and carbon dioxide gas diffuses through the micro-porous first portion of the inner body into the liquid as it flows in the helical flow passage around the first portion of the inner body. The carbonated liquid flows through the helical flow passage around the second portion of the inner body to continue mixing and dissolution of the carbon dioxide in the liquid without an abrupt change in pressure as it passes to the outlet. Conveniently, the first and second portions of the inner body can be formed in one piece of a porous synthetic resin material.

BRIEF DESCRIPTION OF THE DRAWINGS

FIG. 1 is a longitudinal sectional view through an inline carbonator apparatus embodying the present invention;

FIG. 2 is a transverse sectional view taken on the plane 2—2 of FIG. 1;

FIG. 3 is a transverse sectional view taken on the plane 3—3 of FIG. 1; and FIG. 4 is a schematic view of a system for carbonating and dispensing carbonated liquid embodying the present invention.

DETAILED DESCRIPTION

Referring more specifically to FIGS. 1–3, the inline carbonator apparatus comprises a casing 10, preferably of solid plastic material to provide low thermal conductivity. The casing has an elongate chamber with a helically grooved inner wall 12. An elongate inner body 13 is disposed in the chamber and has a cylindrical outer surface contacting the radially inner crests of the helically grooved inner wall to form a helical flow passage therewith. The internally grooved chamber and the inner body are dimensioned to provide a long helical flow passage therebetween and in a relatively compact space. For example, a helical flow passage having an inner diameter of about 1.3 centimeters and an axial length of about 6.5 centimeters and a pitch of about 2.5 turns per centimeter, provides a helical flow passage about 65 centimeters long. The depth of the helical grooves is selected so as to avoid excessive restriction at the desired flow rate during dispensing. For example, for a dispensing rate of 0.3 to 0.6 gpm, the grooves can be formed with a radially inner diameter of about 1.3 centimeters and a radially outer diameter of about 1.5 centimeters, providing a groove depth of about 0.1 centimeters. As is apparent, the length of the helical flow passage can be increased by increasing either the diameter or the length of the internally grooved wall or both, and the depth of the grooves can be changed to accommodate other dispensing flow rates.

A liquid inlet passage 21 is formed in the casing 10 and communicates with the helical flow passage adjacent an inlet end 12*a*. An outlet passage 22 is formed in an end of the body to communicate with the helical flow passage adjacent an outlet end 12*b*. A liquid inlet check valve means 23 is mounted on the casing 10 and arranged to open for flow to the passage 21 and to close to block return flow. A pressure relief valve 24 is also mounted on the casing and arranged to communicate through a passage 25 with the helical passage in the chamber at a location intermediate the inlet and outlet ends of the helical flow passage. A dispensing valve 26, which may be of the manually operated or solenoid operated type, is mounted on the casing and preferably includes an adjustable flow restrictor such as a needle valve 27. Dispensing valves are generally of the off/on type and the adjustable flow restrictor 27 is adjustable to control the flow rate when the dispensing valve is open.

The inner body has an elongate internal chamber 14 having an inlet end 14*a* adjacent the inlet end 12*a* of the helical flow passage, and the internal chamber terminates at a second end 14*b* that is spaced from the first and second ends 12*a*, 12*b* of the helical flow passage. At least the portion 13*a* of the inner member that surrounds the chamber 14 is formed of a micro-porous material to diffuse the carbon dioxide gas as it passes outwardly into the helical flow passage. The other end portion 13*b* of the inner body also forms a helical flow passage in conjunction with the helically grooved inner wall of the casing, and confines the flow of carbonated liquid to an elongated helical flow path as it passes around the second portion of the inner body, to enhance mixing and dissolution of the carbon dioxide in the liquid while avoiding an abrupt change in pressure. In the embodiment illustrated the inner body is conveniently formed in one piece of micro-porous synthetic resin material such as micro-porous polyethylene. It is deemed apparent that the first and second portions of the inner member can be formed in separate pieces and of different materials and that the second portion does not have to be micro-porous. Outlet passage 22 also has a restricted flow area, preferably less than the flow area in the helical passage 12, and the adjustable flow restrictor 27 is adjustable to further restrict flow to the dispensing valve when the latter is open.

Carbon dioxide gas is supplied to the internal chamber 14 in the inner body 13 through a check valve 29 mounted at one end of the casing 10. In the preferred embodiment illustrated, the helically grooved chamber is closed at an inner end 11*a* adjacent the outlet end 12*b* of the helical flow passage and the inner body 13 has an overall length to engage the end 11*a* of the chamber when the inlet fitting 29*a* of the gas check valve 29 is in pressing engagement with the other end of the inner body. With this arrangement, the inner body forms a seal with the end wall 11*a* of the chamber when the gas inlet fitting is tightened into engagement with the inner body.

The casing can conveniently be formed from a block of solid plastic, by drilling a suitably sized bore into the end of the body and thereafter internally threading the bore to form the helically grooved inner wall.

A system for carbonating and dispensing liquid embodying the present invention is illustrated in FIG. 4. Carbon dioxide gas under pressure is supplied from a canister 31 through an adjustable pressure regulator 32 and flow restrictor 33 to the gas inlet check valve 29. The pressure regulator is adjusted to maintain the desired gas pressure, for example 100 to 110 psi, and flow restrictor 33 is provided to control rate of flow of carbon dioxide gas and may for example comprise a length such as five or six inches of capillary tube. Liquid, for example water or water flavored with a syrup, is supplied from a source indicated at 34 through a check valve 35 to a pump 36 driven by a motor 37. When the pump is operated, the pump delivers liquid under pressure through a cooling coil 38 in the cooler 39 and through check valve 23 to the helical flow passage. Pump drive motor 37 is operated under the control of a pressure switch 41 that is responsive to the liquid pressure in the helical flow passage and is operative to control operation of the pump in a manner to maintain the pressure on the liquid supplied to the flow passage in a selected range.

From the foregoing, it is believed that the construction and operation of the carbonation apparatus will be readily understood. It is assumed that the apparatus has been operated through at least several dispensing cycles and the liquid and gas pressures have been adjusted and stabilized at the desired pressures. When the dispensing valve 26 is opened, the liquid pressure in the helical flow passage drops and pressure switch 41 starts the pump 36 to deliver liquid to the inlet end of the helical flow passage at a flow rate determined by dispensing valve 26 and outlet flow actuator 27. Carbon dioxide gas under pressure controlled by regulator 32 and at a rate controlled by flow restrictor 33 flows into chamber 14 and diffuses through the portion 13*a* of the inner member into liquid in the helical flow passage around portion 13*a*. The carbonated liquid continues to flow in a helical flow passage as it passes along portion 13*b* of the inner member for further mixing dissolution, and then flows through passage 22 and outlet flow restrictor 27 and through the dispensing valve. When the dispensing valve is closed, the pressure rises in the helical flow path and the pump is shut off.

The embodiments of the invention in which an exclusive property or privilege is claimed are defined as follows:

1. An inline carbonator apparatus comprising, casing means defining an elongate chamber having a helically grooved inner wall, an elongate inner body disposed in the chamber and having a cylindrical outer surface contacting radially inner crests on the helically grooved inner wall and forming a helical flow passage therewith, means for passing liquid to be carbonated to the helical flow passage adjacent an inlet end thereof, outlet means communicating with an outlet end of said helical flow passage; said inner body having an elongate internal chamber extending from a first end adjacent said inlet end of the helical flow passage to a location spaced from the inlet and outlet ends of the helical flow passage, at least the portion of the inner body that extends around the internal chamber being formed of micro-porous material, and means for passing carbon dioxide gas to the internal chamber in the inner body for diffusion through the micro-porous portion of the inner body into the liquid in the helical flow passage.

2. An inline carbonator apparatus according to claim 1 wherein said porous material is a porous synthetic resin material.

3. An inline carbonator apparatus according to claim 1 wherein the helical grooves have a uniform pitch along the inner wall of the casing means and a plurality of convolutions per centimeter.

4. An inline carbonator apparatus according to claim 1 wherein said casing means has end wall means adjacent said outlet end of the helical flow passage, said inner body having a second end engaging said end wall means.

5. An inline carbonator apparatus according to claim 1 wherein said casing means has end wall means adjacent said outlet end of the helical flow passage, said internal chamber opening at said first end of the inner body, said means for passing carbon dioxide gas including a fitting detachably mounted on one end of the casing means and engaging said first end of the inner body and holding the inner body with the other end thereof in engagement with said casing end wall means.

6. An inline carbonator apparatus according to claim 1 wherein the inner body is formed in one piece of porous synthetic resin material.

7. A system for carbonating liquid comprising, casing means defining an elongate chamber having a helically grooved inner wall, an elongate inner body disposed in the chamber and having a cylindrical outer surface contacting radially inner crests on the helically grooved inner wall and forming a helical flow passage therewith, means including a motor driven pump for passing liquid to be carbonated to the helical flow passage adjacent a first end thereof, a dispensing valve, outlet passage means including an adjustable flow restrictor communicating with said helical flow passage adjacent an outlet end thereof for passing carbonated liquid to the dispensing valve, said inner body having an elongate internal chamber extending from a first end adjacent said inlet end of the helical flow passage to a location spaced from the inlet and outlet ends of the helical flow passage, at least the portion of the inner body that extends around the internal chamber being formed of micro-porous material, means including an adjustable gas pressure regulator and a gas-line flow restrictor for passing carbon dioxide gas to the internal chamber in the inner body for diffusion through the micro-porous portion of the inner body into the liquid in the helical flow passage, and means including a pressure switch for controlling operation of the pump to maintain the pressure on the liquid supplied to the helical flow passage in a selected range.

8. A system for carbonating liquid according to claim 7 wherein the porous material is a porous synthetic resin material.

9. A system for carbonating liquid according to claim 7 wherein said dispensing valve is mounted on said casing means.

10. A system for carbonating liquid according to claim 7 wherein the inner body is formed in one piece of porous synthetic resin material.

* * * * *